US006369554B1

(12) United States Patent
Aram

(10) Patent No.: US 6,369,554 B1
(45) Date of Patent: Apr. 9, 2002

(54) LINEAR REGULATOR WHICH PROVIDES STABILIZED CURRENT FLOW

(75) Inventor: Farbod Aram, Cupertino, CA (US)

(73) Assignee: Marvell International, Ltd., Hamilton (BM)

( * ) Notice: Subject to any disclaimer, the term of this patent is extended or adjusted under 35 U.S.C. 154(b) by 0 days.

(21) Appl. No.: 09/654,392

(22) Filed: Sep. 1, 2000

(51) Int. Cl.[7] ..... G05F 1/40; G05F 1/44; G05F 1/56

(52) U.S. Cl. ..... 323/282; 323/284; 323/274

(58) Field of Search ..... 323/271, 273, 323/274, 282, 284

(56) References Cited

U.S. PATENT DOCUMENTS

| | | | | | |
|---|---|---|---|---|---|
| 5,548,205 | A | * | 8/1996 | Monticelli | 323/274 |
| 5,648,718 | A | * | 7/1997 | Edwards | 323/274 |
| 5,852,359 | A | * | 12/1998 | Callahan, Jr. et al. | 323/274 |
| 5,909,109 | A | * | 6/1999 | Philips | 323/277 |
| 5,929,616 | A | * | 7/1999 | Perraud et al. | 323/274 |
| 6,011,666 | A | | 1/2000 | Wakamatsu | 360/69 |
| 6,061,306 | A | | 5/2000 | Buchheim et al. | 369/2 |
| 6,084,387 | A | * | 7/2000 | Kancko et al. | 323/281 |

FOREIGN PATENT DOCUMENTS

| | | | |
|---|---|---|---|
| EP | 0 985 732 A1 | 8/1999 | G11C/7/00 |
| EP | 0 999 549 549 A2 | 11/1999 | G11B/20/10 |
| WO | PCT/US99/05734 | 3/1999 | H04N/7/167 |

OTHER PUBLICATIONS

Paul C. Yu, et al., "A 2.5–V, 12–b, 5–Msample/s Pipeland CMOS ADC," IEEE Journal of Solid–State Circuits, vol, 31, No. 12, Dec. 1996, pp. 1854–61.

Stephen H. Lewis, et al., "Indirect Testing of Digital–Correction Circuits in Analog–to–Digital Converters with Redundancy," IEEE Transactions on Circuits and Systems–II: Analog and Digital Signal Processing, vol. 42, No. 7, Jul. 1995, pp. 437–445.U.S. application No. 09/643, 819, Aram, filed Aug. 22, 2000.

U.S. application No.09/648,770, Aram et al., filed Aug. 28, 2000.

U.S. application No. 09/648,462, Aram et al., filed Aug. 28, 2000.

U.S. application No. 09/648,464, Aram, filed Aug. 28, 2000.

Quantum Online / Inside Hard Disk Drives, "Part 2—A Closer Look at Hard Disk Drives"; "Chapter 3—Inside Hard Disk Drives—How They Work", Jun. 7, 2000.

(List continued on next page.)

*Primary Examiner*—Bao Q. Vu
(74) *Attorney, Agent, or Firm*—Eric B. Janofsky

(57) ABSTRACT

A linear regulator operable from a source voltage provides a regulated voltage to a load. The linear regulator includes a bipolar device connected between the source voltage and the load with an output of the bipolar device connected to output the regulated voltage, a feedback amplifier connected in negative feedback relationship between the output of the bipolar device and a reference voltage so as to provide a stabilized voltage, and a capacitor amplification circuit connected between the stabilized voltage and the output of the bipolar device. The capacitive amplification circuit includes a MOSFET n-channel device connected to a base of the bipolar device so as to stabilize current flow from the base to the output of the bipolar device. The capacitor amplification circuit includes an amplifier and a capacitor connected in feedback relationship with the output of the linear regulator, with an output of the amplifier stage providing a reference signal to the gate of the MOSFET device. Most preferably, a 1:n current mirror provides even greater current independence for the frequency characteristics of the linear regulator.

12 Claims, 3 Drawing Sheets

OTHER PUBLICATIONS

Quantum Online/Recent Technological Developments, "Chapter 4–The Impact of Leading—Edge Technology on Mass Storage", Jun. 7, 2000.

Curtis Settles, "DSP–augmented CPU cores promise performance boost for ultra–compact drives", Data Storage, May 2000, pp. 35–38.

Stephen H. Lewis, "Optimizing the Stage Resolution in Pipelined, Multistage, Analog–to–Digital Converters for Video–Rate Applications", IEEE Transactions on Circuits and Systems—II: Analog and Digital Signal Processing, vol. 30, No. 8, Aug. 1992.

Stephen H. Lewis, et al., "A 10–b 20–Msample/s Analog-to–Digital Converter", IEEE Journal of Solid–State Circuits, vol. 27, No. 3, Mar. 1992, pp. 351–358.

Stephen H. Lewis and Paul R. Gray, "A Pipelined 5–Msample/s 9–bit Analog–to–Digital Converter", IEEE Journal of Solid–State Circuits, vol. SC–22, No. 6, Dec. 1987, pp. 954–961.

Bhupendra K. Ahuja, "An Improved Frequency Compensation Technique for CMOS Operational Amplifiers", IEEE Journal of Solid–State Circuits, vol. SC–18, No. 6, Dec. 1983, pp. 629–633.

Sehat Sutardja and Paul R. Gray, "A Pipelined 13–bit, 250–ks/s, 5–V Analog–to–Digital Converter", IEEE Journal of Solid–State Circuits, vol. 23, No. 6, Dec. 1988, pp. 1316–1323.

* cited by examiner

LINEAR REGULATOR WHICH PROVIDES STABILIZED CURRENT FLOW

BACKGROUND OF THE INVENTION

1. Field of the Invention

The present invention relates to a linear regulator to provide a regulated voltage to a load and particularly relates to frequency compensation for such a linear regulator.

2. Background of the Invention

Linear regulators are well-known devices that provide a regulated voltage to a load based on a source voltage and (usually) a reference voltage. FIG. 1 shows a conventional arrangement in which linear regulator 10 is connected to a source voltage V+ and provided with a reference voltage Vref so as to provide a regulated voltage to load 12.

To compensate for frequency-induced variations in current drawn by load 12, a load capacitor $C_L$ is often provided. Because there are often high fluctuations in the current drawn by load 12, however, a large value for $C_L$ is required, typically from 1 to 100 $\mu$f. Such a large value is disadvantageous since large capacitors are large physically and also expensive.

As seen in FIG. 2, a conventional linear regulator 10 includes a bipolar device BP2 connected between the source voltage and the load so as to provide a regulated output voltage. The regulated output voltage is stabilized with a unity gain negative feedback amplification circuit through amplifier A1 which is provided with a reference voltage. A capacitive amplification circuit 13 includes a bipolar device BP1, amplifier A3 and capacitor Cm in a feedback relationship.

Although good results have been obtained with the linear regulator shown in FIG. 2, difficulties are still encountered. Most notably, the frequency roll off characteristics of the linear regulator shown at 10 are highly dependent on the actual value of the current drawn by load 12. Thus, for example, highest frequency roll off for linear regulator 10 depends on inherent resistive and capacitive effects of bipolar device BP2 (shown schematically at $r\pi$ and $c\pi$). In addition, the load capacitor $C_L$ actually includes a small series resistance Rs which introduces at least one additional zero into the frequency response of linear regulator 10. As a result of the additional zero, as well as the current dependence of system poles, it is easy to introduce instabilities in the linear regulator shown at 10 unless the current range of load 12 is small (for example, between 0 and 200 milliamps) and unless $C_L$ is a high quality capacitor such that its series resistance Rs is very small.

SUMMARY OF THE INVENTION

It is an object of the invention to provide a linear regulator whose frequency characteristics are less dependent on the amount of current drawn by load 12, and which exhibits a higher degree of frequency compensation than known linear regulators.

In one aspect, the invention is a linear regulator in which a capacitive amplification circuit includes a MOSFET device connected to the base of a bipolar output device so as to stabilize the current flow from the base to the output. Because a MOSFET device is used rather than the bipolar devices found in the prior art, a linear regulator according to the present invention exhibits frequency characteristics whose dependence is less than that of the prior art.

Thus, a linear regulator operable from a source voltage to provide a regulated voltage to a load includes a bipolar device connected between the source voltage and the load with an output of the bipolar device connected to output the regulated voltage, a feedback amplifier connected in negative feedback relationship between the output of the bipolar device and a reference voltage so as to provide a stabilized voltage, and a capacitor amplification circuit connected between the stabilized voltage and the output of the bipolar device. The capacitive amplification circuit includes a MOSFET device connected to a base of the bipolar device so as to stabilize current flow from the base to the output of the bipolar device. The capacitor amplification circuit includes an amplifier and a capacitor connected in feedback relationship with the output of the linear regulator, with an output of the amplifier stage providing a reference signal to the gate of the MOSFET device. Most preferably, a 1:n current mirror provides even greater current independence for the frequency characteristics of the linear regulator.

This brief summary has been provided so that the nature of the invention may be understood quickly. A more complete understanding of the invention can be obtained by reference to the following detailed description of the preferred embodiment thereof in connection with the attached drawings.

DETAILED DESCRIPTION OF THE PREFERRED EMBODIMENT

Figure 3:
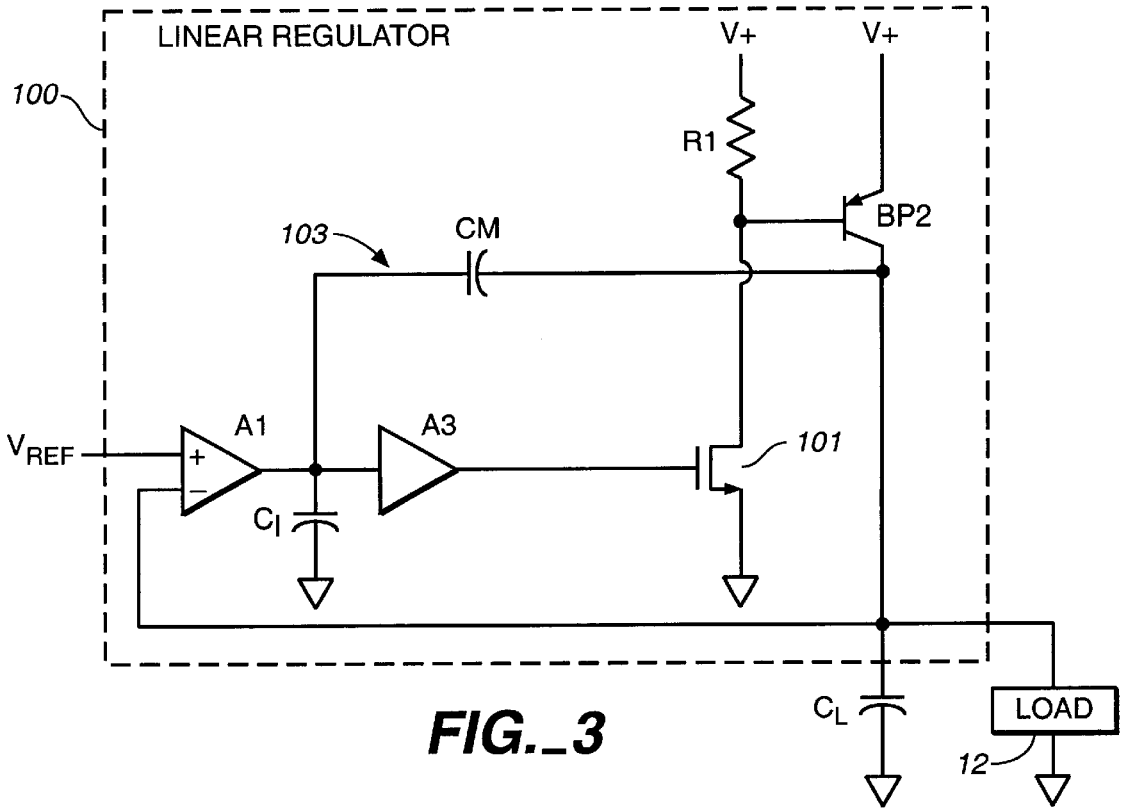
FIGS. 3 and 4 are views for explaining linear regulators according to the present invention.

As shown in FIG. 3, linear regulator 100 is connected to a voltage source V+ so as to provide a regulated output voltage to a load 12. The linear regulator includes a bipolar device BP2 with its emitter connected to the source voltage and its collector connected to the regulated output voltage, so as to supply the regulated output voltage to load 12. The regulated output voltage is connected in a negative feedback relationship through amplifier A1 to a reference voltage Vref so as to set the voltage level of the output voltage. The output of amplifier A1 is connected to a capacitive amplification circuit 103 which is arranged to stabilize the current flowing from the base of bipolar device BP2 to its collector. In particular, the capacitive amplification circuit 103 includes a MOSFET device 101 with its drain connected to the base of bipolar device BP2 and its source connected to ground. A p-channel or n-channel device 101 may be used; in the illustrated embodiment an n-channel device is shown. A small capacitor (typically 10 to 20 pf) Cm is connected between the output of the linear regulator and the input of amplifier A3. Connection of Cm in this manner is a well-known technique to amplify the effective value of capacitance Cm.

Figure 1:
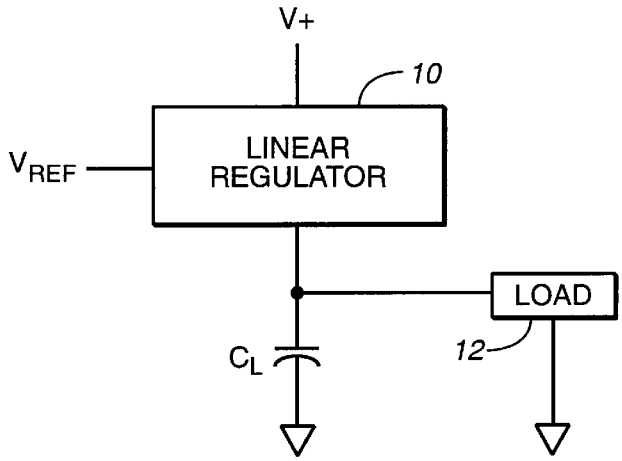
FIG. 1 (PRIOR ART)
FIGS. 1 and 2 are views for explaining conventional linear regulators.
Figure 2:
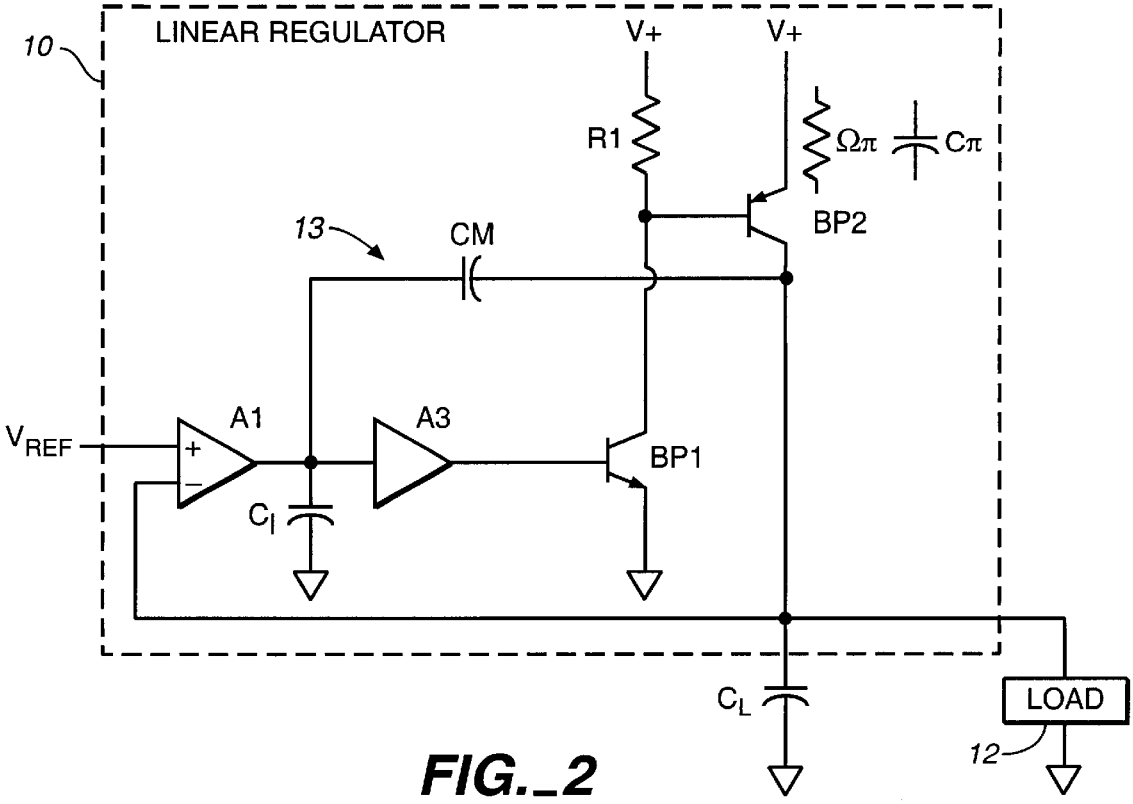
FIG. 2 (PRIOR ART)

By virtue of the capacitive amplification circuit 103 which includes a MOSFET device, with the MOSFET device stabilizing current between the base and collector of bipolar device BP2, a linear regulator with improved frequency characteristics is obtained. In particular, frequency characteristics of the prior art linear regulator shown in FIG. 2 are linearly proportional to the value of the current. On the other hand, frequency characteristics of the linear regulator according to the present invention are proportional only to the square root of the current.

Figure 4:
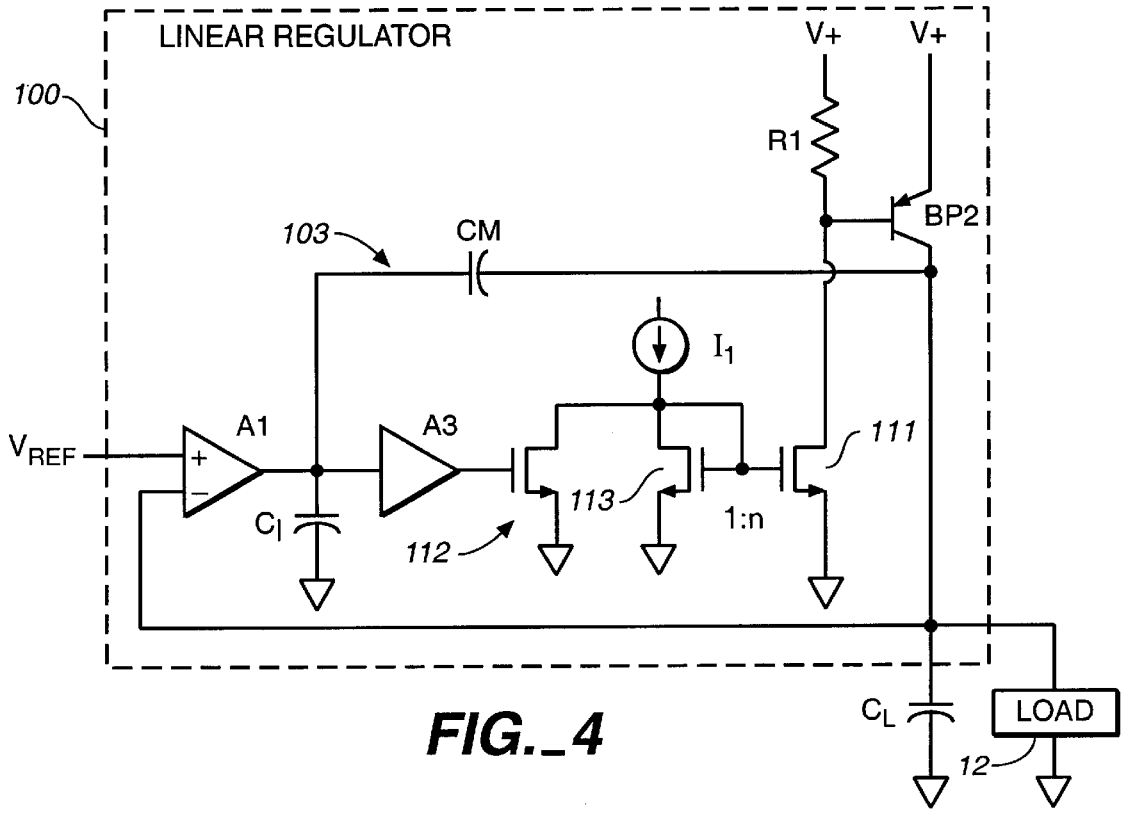
Figure 5:
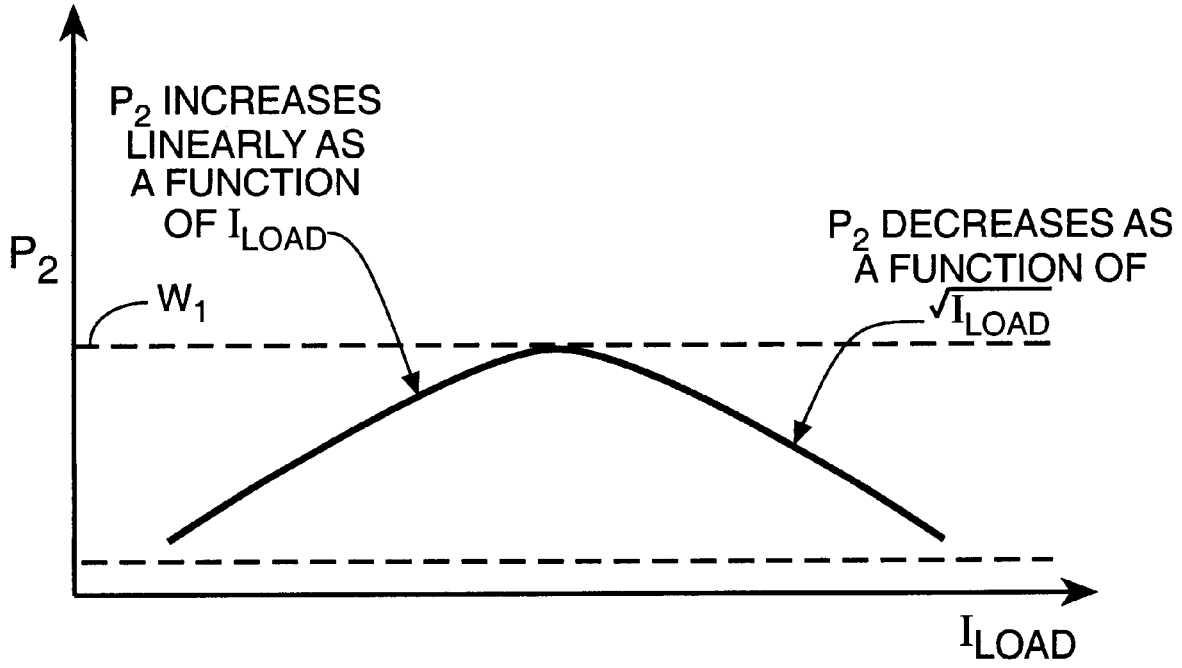
FIG. 5 is a view for explaining the frequency variation of a second pole due to $C_L$ according to the linear regulator of FIG. 4.

FIG. 4 shows a linear regulator according to another embodiment of the present invention. The components that are the same as those described above with respect to FIG. 3 will not be discussed again. With reference to FIG. 4, linear regulator 100 includes a current source $I_1$, 1:n current mirror, and MOSFET 112. MOSFET 112 is preferably configured as a common-source amplifier, and the 1:n current mirror includes MOSFET 113 and 111. Because of the FIG. 4 configuration, a second non-dominant pole ($P_2$), due to the $C_L$ capacitor, linearly increases in frequency as a function of load current $I_{Load}$ up to a frequency w1, as shown in FIG. 5. Pole $P_2$ then decreases in frequency according to the square root of the load current $I_{Load}$, even though $I_{Load}$ continues to increase. Accordingly, the variation (or range of variation) in $P_2$ is confined.

The invention has been described with respect to particular illustrative embodiments. It is to be understood that the invention is not limited to the above-described embodiments and that various changes and modifications may be made by those of ordinary skill in the art without departing from the spirit and scope of the invention.

What is claimed is:

1. A linear regulator operable from a source voltage to provide a regulated voltage to a load, said linear regulator comprising:

a bipolar device connected between the source voltage and the load, with an output of said bipolar device connected to output the regulated voltage;

a feedback amplifier connected in negative feedback between the output of said bipolar device and a reference voltage so as to provide a stabilized voltage; and a capacitor amplification circuit connected between the stabilized voltage and the output of said bipolar device;

wherein said capacitor amplification circuit includes a first MOSFET device connected to a base of said bipolar device so as to stabilize current flow from the base to the output of said bipolar device, said first MOSFET device comprising a 1:n current mirror wherein said capacitor amplification circuit includes an amplifier and a capacitor in a feedback relationship between an input of said amplifier and the output of the linear regulator, and wherein said capacitor amplification circuit includes a common-source amplifier communicating between said amplifier and the 1:n current mirror.

2. A linear regulator according to claim 1, wherein said capacitor amplification circuit includes an amplifier and a capacitor in a feedback relationship between an input of said amplifier and the output of the linear regulator, and wherein said MOSFET device includes a source connected to the base of said bipolar device and a gate connected to an output of said amplifier.

3. A linear regulator according to claim 1, wherein said 1:n current mirror includes the first MOSFET device and a second MOSFET device, wherein said capacitor amplification circuit includes a current source, wherein said first MOSFET device includes a source connected to the base of said bipolar device and includes a gate, and wherein said current source is connected to a gate and a source of the second MOSFET device and to the gate of the first MOSFET device.

4. A linear regulator according to claim 1, wherein said first MOSFET device is an n-channel device.

5. A linear regulator operable from a source voltage to provide a regulated voltage to a load, said linear regulator comprising:

bipolar means connected between the source voltage and the load, with an output of said bipolar means connected to output the regulated voltage;

feedback amplifier means connected in negative feedback between the output of said bipolar means and a reference voltage for providing a stabilized voltage; and capacitor amplification means connected between the stabilized voltage and the output of said bipolar means for stabilizing current flow;

wherein said capacitor amplification means includes a first MOSFET means connected to a base of said bipolar means for stabilizing current flow from the base to the output of said bipolar for stabilizing current flow, said first MOSFET means comprising a 1:n current mirror means, wherein said capacitor amplification means includes amplifying means and capacitor means in a feedback relationship between an input of said amplifying means and the output of the linear regulator, and wherein said capacitor amplification means includes a common-source amplifying means communicating between said amplifying means and the 1:n current mirror means.

6. A linear regulator according to claim 5, wherein said capacitor amplification means includes amplifier means and capacitor means in feedback relationship between an input of said amplifier means and the output of the linear regulator, and wherein said first MOSFET means includes a source connected to the base of said bipolar means and a gate connected to an output of said amplifier means.

7. A linear regulator according to claim 5, wherein said 1:n current mirror means includes the first MOSFET means and a second MOSFET means, wherein said capacitor amplification means includes a current source means, wherein said first MOSFET means includes a source connected to the base of said bipolar means and includes a gate, and wherein said current source means is connected to a gate and a source of the second MOSFET means and to the gate of the first MOSFET means.

8. A linear regulator according to claim 7, wherein said MOSFET means is an n-channel device.

9. A linear regulator according to claim 1, wherein said feedback amplifier and said capacitor amplification circuit cause the linear regulator to have a frequency response characteristic that linearly increases as a function of load current up to a predetermine frequency, but then decreases according to a non-linear function of the load current even when the load current continues to increase.

10. A linear regulator according to claim 7, wherein said feedback amplifier means and said capacitor amplification means cause the linear regulator to have a frequency response characteristic that linearly increases as a function of load current up to a predetermine frequency, but then decreases according to a non-linear function of the load current even when the load current continues to increase.

11. A linear regulator operable from a source voltage to provide a regulated voltage to a load through a bipolar device that is connected between the source voltage and the load, an output of the bipolar device being connected to output the regulated voltage, said linear regulator comprising:

a feedback amplifier connected in negative feedback between the output of the bipolar device and a reference voltage so as to provide a stabilized voltage; and a capacitor amplification circuit connected between the stabilized voltage and the output of the bipolar device;

wherein said capacitor amplification circuit includes a first MOSFET device connected to a base of the bipolar device so as to stabilize current flow from the base to the output of the bipolar device, said first MOSFET device comprising a 1:n current mirror wherein said capacitor amplification circuit includes an amplifier and a capacitor in a feedback relationship between an input of said amplifier and the output of the linear regulator, and wherein said capacitor amplification circuit includes a common-source amplifier communicating between said amplifier and the 1:n current mirror.

12. A linear regulator according to claim 11 , wherein said feedback amplifier and said capacitor amplification circuit cause the linear regulator to have a frequency response characteristic that linearly increases as a function of load current up to a predetermine frequency, but then decreases according to a non-linear function of the load current even when the load current continues to increase.

* * * * *